US005996442A

United States Patent [19]

Carmien

[11] Patent Number: 5,996,442

[45] Date of Patent: Dec. 7, 1999

[54] HAND TOOL HAVING INTERCHANGEABLE AND REPLACEABLE STRIKING HEADS, AND ASSEMBLY PROCESS

[76] Inventor: Joseph Allen Carmien, 525 N. Maple Dr., Beverly Hills, Calif. 90210

[21] Appl. No.: 09/113,735

[22] Filed: Jul. 10, 1998

Related U.S. Application Data

[60] Provisional application No. 60/055,385, Aug. 5, 1997.

[51] Int. Cl.[6] ..... B25D 1/02

[52] U.S. Cl. ..... 81/25; 30/308; 294/53.5; 403/349

[58] Field of Search ..... 81/20, 25, 489; 30/308, 308.1, 308.3; 7/145; 294/51, 53.5; 403/349

[56] References Cited

U.S. PATENT DOCUMENTS

| | | | |
|---|---|---|---|
| Re. 32,364 | 2/1987 | Carmien . | |
| 404,663 | 6/1889 | Thompson et al. . | |
| 657,422 | 9/1900 | Judd . | |
| 894,155 | 7/1908 | Layton . | |
| 1,374,336 | 4/1921 | Surbaugh . | |
| 1,435,851 | 11/1922 | Isham . | |
| 1,755,236 | 4/1930 | Brandenburg . | |
| 2,031,556 | 2/1936 | Brandenburg . | |
| 2,052,616 | 9/1936 | Gardes . | |
| 2,063,774 | 12/1936 | Washington . | |
| 2,205,769 | 6/1940 | Sweetland . | |
| 2,238,104 | 4/1941 | Finley . | |
| 2,517,902 | 8/1950 | Luebkeman . | |
| 2,761,478 | 9/1956 | Guida | 81/25 X |
| 2,837,381 | 6/1958 | Sarlandt . | |
| 2,850,331 | 9/1958 | Curry et al. . | |
| 2,948,649 | 8/1960 | Pancherz . | |
| 3,018,140 | 1/1962 | Portz et al. . | |
| 3,232,355 | 2/1966 | Woolworth . | |
| 3,549,189 | 12/1970 | Alosi . | |
| 3,556,888 | 1/1971 | Goldsworthy . | |
| 3,620,159 | 11/1971 | Gould . | |
| 3,721,282 | 3/1973 | Hayes et al. | 81/25 |
| 3,753,602 | 8/1973 | Carmien . | |
| 3,762,453 | 10/1973 | Merrow et al. . | |
| 3,819,288 | 6/1974 | Carmien . | |
| 3,845,798 | 11/1974 | Palumbo | 30/308.1 |
| 3,874,433 | 4/1975 | Shepherd, Jr. et al. . | |

(List continued on next page.)

FOREIGN PATENT DOCUMENTS

| | | | |
|---|---|---|---|
| 1064418 | 5/1954 | France . | |
| 2555098A | 5/1985 | France . | |
| 830030 | 1/1952 | Germany | 81/25 |
| 129611 | 10/1950 | Sweden . | |
| 3424 | 7/1882 | United Kingdom . | |
| 1376180 | 1/1972 | United Kingdom . | |
| 2093398A | 9/1982 | United Kingdom . | |
| PCT/SE84/0036 | 8/1984 | WIPO . | |

*Primary Examiner*—James G. Smith
*Attorney, Agent, or Firm*—Kelly Bauersfeld Lowry & Kelley, LLP

[57] ABSTRACT

A process for releasably attaching a tool handle to a tool head includes the steps of (1) inserting an end of the tool handle into the tool head through a tool head aperture, (2) turning the end of the tool handle relative to the tool head to engage a pair of lands therein which prevent withdrawal of the end of the tool handle from the tool head, and (3) threading a nut onto the tool handle so as to engage a portion of the tool head adjacent to the aperture. The process is accomplished by providing the handle a connecting stud at one end thereof, wherein the connecting stud includes a pair of oppositely disposed flanges which extend generally perpendicularly outwardly therefrom. The tool head has a central cavity into which the connecting stud is inserted through the aperture. The pair of lands are capable of selectively engaging the connecting stud flanges to prevent withdrawal of the connecting stud from the tool head. The nut is threadable onto the connecting stud and has a face for engaging a portion of the tool head adjacent to the aperture to prevent movement of the connecting stud relative to the tool head and to thereby releasably secure the tool head to the handle.

17 Claims, 4 Drawing Sheets

U.S. PATENT DOCUMENTS 3,877,826 4/1975 Shepherd, Jr. et al. .
3,915,782 10/1975 Davis et al. .
3,917,421 11/1975 Carmien et al. .
4,030,847 6/1977 Carmien .
4,039,012 8/1977 Cook .
4,050,727 9/1977 Bonnes .
4,085,784 4/1978 Fish .
4,139,930 2/1979 Cox .
4,287,640 9/1981 Keathley .
4,291,998 9/1981 Santos .
4,367,979 1/1983 Milligan .
4,404,708 9/1983 Winter .
4,424,183 1/1984 Nelson .
4,451,073 5/1984 Carmien .
4,570,988 2/1986 Carmien .
4,605,254 8/1986 Carmien .
4,639,029 1/1987 Kolonia .
4,697,481 10/1987 Maeda .
4,743,481 5/1988 Quinlan et al. .
4,753,137 6/1988 Kennedy ..... 81/25 X
5,031,272 7/1991 Carmien .
5,056,381 10/1991 Carmien .
5,123,304 6/1992 Carmien .
5,262,113 11/1993 Carmien .
5,375,486 12/1994 Carmien .

HAND TOOL HAVING INTERCHANGEABLE AND REPLACEABLE STRIKING HEADS, AND ASSEMBLY PROCESS

This application claims the benefit of U.S. Provisional Application No. 60/055,385 filed Aug. 5, 1997.

BACKGROUND OF THE INVENTION

This invention relates generally to hand tools. More particularly, the present invention relates to a composite hand tool having interchangeable and replaceable striking heads, and a related assembly process.

Traditionally, in percussive tools such as sledge hammers, the tool head includes an aperture or eyehole through its body which has a single or double taper. In both cases, the taper expands at the top of the tool head or that portion which is normally directed away from the user when the tool is in use. When a wooden handle is driven through the eyehole from the bottom side of the tool head, the excess wood protruding from the top side is cut off, and some wedging device, such as an ordinary wedge, is driven into the wood so that the upper end thereof is expanded to provide an inverted frustum which, theoretically, is tightly expanded into the tool eyehole. The expanded section of wood must fit within the upper tapered portion of the eyehole tightly so that the head cannot fly off during use. This is a very elemental assembly which has been in use for many years.

Recent years have seen the development of extremely strong composite tool handles formed of reinforcing fibers cured within a resin composite. Such reinforcing fibers may include fiberglass, polyester, boron, kevlar or graphite, and suitable resin composites include polyester, epoxy, phenolics, etc. With the development of these composite materials, the shaft underneath the tool head can now be made with a cross-section small enough to pass through the conventional eyehole of percussive tool heads, and yet be strong enough to withstand the impact forces likely to be encountered.

As advanced materials have been introduced to replace wood, the materials have been either bonded into the eyehole of the tool, substituting the bond for the old traditional wedge, and/or welded such as metal to metal. Whereas these techniques are suitable to some degree for the manufacture of original tools in which the handle is installed with appropriate machinery and equipment at a factory, the techniques are not suitable when practiced in the field. In the case of bonding, composite shafts have been attached to tool heads primarily by means of adhesives in the epoxy field. When utilizing such adhesives, despite the continued development of these materials, it takes care, precision and good workmanship to properly install a replacement handle in a tool head reliably in the field with no secondary tools to assist. Even in factories where the tool head is installed on a production basis, high levels of quality control must be practiced in order to insure that the head is secured to the handle under all anticipated working conditions. Further, since the high strength composite shafts are usually inadequate in cross-sectional size to be comfortable for a user's hands, a grip of rubber or some other plastic material is usually molded onto the shaft or subsequently bonded thereto in a manner which guarantees that the grip will not accidentally slide off the shaft.

U.S. Pat. No. 5,056,381 illustrates a hand tool which addresses many of the drawbacks of the prior art discussed above. There a replacement tool handle for a percussive tool is shown which includes a high strength, load-bearing rod which is inserted through the eyehole of a tool head from its upper end, a grip which ensheathes a portion of the rod projecting from a lower end of the tool head, and two interlocking members which fasten the grip to the rod. The rod includes a handle shaft capable of passing completely through the eyehole of the tool head, and a shaft retainer located at a first end of the shaft for preventing an adjacent end of the rod from passing through the eyehole. The shaft retainer forms a generally frusto-conical slug having an outer surface portion generally corresponding to a portion of the eyehole, an enlarged portion which is incapable of passing through the eyehole, and an inner cavity in which the first end of the shaft is secured. Both the handle shaft and an internal cavity provided the grip have non-circular cross-sections to prevent turning of the grip relative to the shaft. The interlocking members each include tooth portions which engage one another within the outer periphery of the handle in a manner which denies access to a user, thus ensuring a permanent connection.

With the trend toward miniaturization in many industries, there has developed the need for specialized tools to service new lines of product. This applies to striking tools (with percussive tool heads) as well as other specialty tool products. For example, maintenance people who service computers, copy machines, typewriters and the like must be able to carry a variety of striking tools in a very compact space.

Accordingly, there is a need for a novel hand tool which has interchangeable and replaceable striking heads, wherein a single handle may be packaged with a number of different types of striking heads into a kit which is compact and easily utilized in the field by maintenance people. The hand tool must be of such a construction that the tool head and the tool handle may be assembled to one another reliably and efficiently in such a manner which effectively prohibits the tool head from flying off the handle unintentionally. Preferably, the assembly should include a minimum number of separate parts, and should utilize standard manufacturing processes in order to reduce overall costs. Moreover, such a hand tool should permit use of a wide variety of striking tips having differing characteristics in order to maximize the flexibility of the resultant product. The present invention fulfills these needs and provides other related advantages.

SUMMARY OF THE INVENTION

The present invention resides in a novel hand tool and a process for releasably attaching a tool handle to a tool head. The hand tool comprises, generally, a handle having a connecting stud at one end thereof, a tool head having an aperture through which the connecting stud may be inserted, and a nut which is threadable onto the handle and which may be positioned so as to engage a portion of the tool head. The tool head includes a land capable of selectively engaging a portion of the connecting stud to prevent withdrawal of the connecting stud from the tool head. The nut has a face for engaging a portion of the tool head adjacent to the aperture to prevent movement of the connecting stud relative to the tool head and thereby releasably secure the tool head to the handle.

In an illustrated form of the invention, the connecting stud has a pair of oppositely disposed flanges which extend generally perpendicularly outwardly therefrom. The tool head also includes a pair of lands which extend into a central cavity of the tool head, which lands are capable of selectively engaging the connecting stud flanges to prevent withdrawal of the connecting stud from the tool head. The connecting stud flanges and the tool head lands have complementary surface contours which prevent rotation of the handle relative to the tool head when the connecting stud flanges are seated on the corresponding tool head lands and the nut engages the tool head. The connecting stud further includes a shoulder spaced from the flanges that engages the lands when the connecting stud is inserted into the tool head, to limit the length of handle insertion into the tool head. The connecting stud further includes a cylindrical body portion which defines the connecting stud shoulder. The cylindrical body portion is insertable through the tool head aperture and is positioned within a cylindrical cavity of the tool head having substantially the same diameter as the connecting stud.

The tool head comprises a tool head body into which the connecting stud is inserted, and at least one striking tip which is affixed to and extends from the tool head body. The striking tip may be of a different material than the tool head body. The handle comprises a high-strength, load-bearing rod to which the connecting stud is attached, and a grip attached over an end of the rod opposite the connecting stud.

In accordance with the novel process of the present invention, an end of the tool handle is inserted into the tool head through an aperture thereof, and the end is then turned relative to the tool head so as to engage the lands therein in order to prevent withdrawal of the end of the tool handle from the tool head. The nut is then threaded onto the tool handle so as to engage a portion of the tool head adjacent to the aperture, to releasably secure or attach the tool handle to the tool head.

More specifically, the end of the tool handle is defined by an attached connecting stud including the pair of oppositely disposed flanges described above. The tool head is also configured so as to include a central cavity into which the connecting stud may be inserted through a tool head aperture, wherein the tool head further includes a pair of lands which extend into the central cavity, also as described above. When the connecting stud is inserted through the aperture into the central cavity of the tool head, the flanges pass by the lands without engaging them. During the turning step, the flanges move so as to engage the lands within the tool head, thereby preventing withdrawal of the connecting stud, and therefore the end of the tool handle to which the connecting stud is attached, from the tool head. Further, during the turning step, the tool handle and tool head are rotated about a longitudinal axis of the tool handle relative to one another through an arc of less than 360°, and preferably of about 90°.

The process further includes the step of preventing rotation of the handle relative to the tool head when the flanges engage the lands and the nut engages the tool head. This is accomplished by providing the flanges and the lands with complementary surface contours, and by threading the nut directly onto a lower end of the connecting stud until it engages a portion of the tool head adjacent to its aperture.

The process additionally includes the step of limiting the length of handle insertion into the tool head. The limiting step is accomplished by providing the connecting stud with a shoulder spaced from the flanges. The shoulder engages the lands when the connecting stud is inserted into the tool head to effectively limit the length of handle insertion into the tool head.

Other features of and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
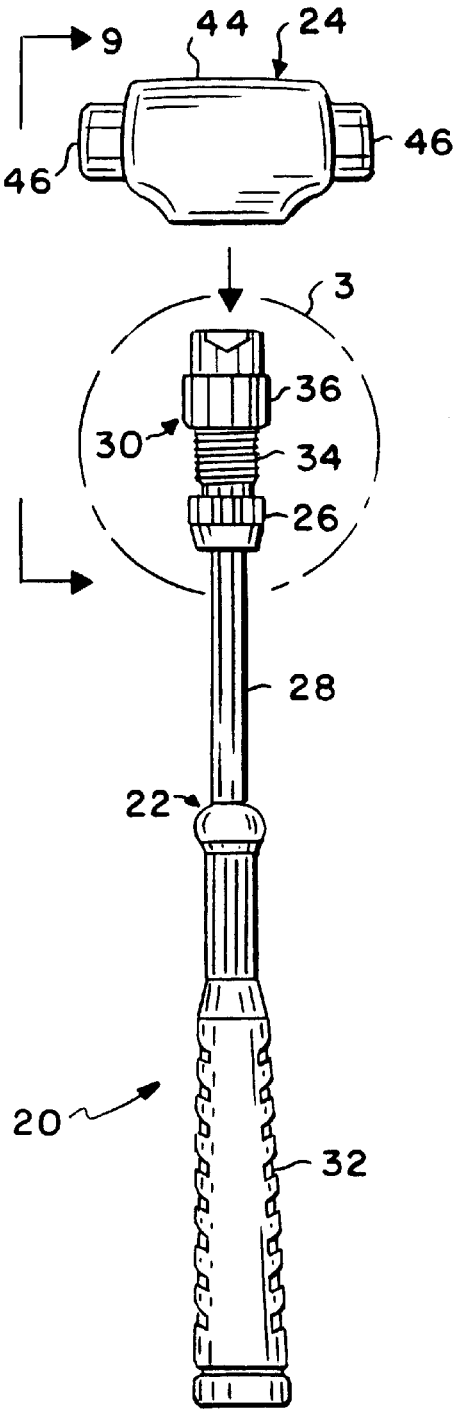
FIG. 1 is an exploded side elevational view of a hand tool embodying the invention, wherein a tool head is shown immediately above a connecting stud portion of a tool handle.
Figure 2:
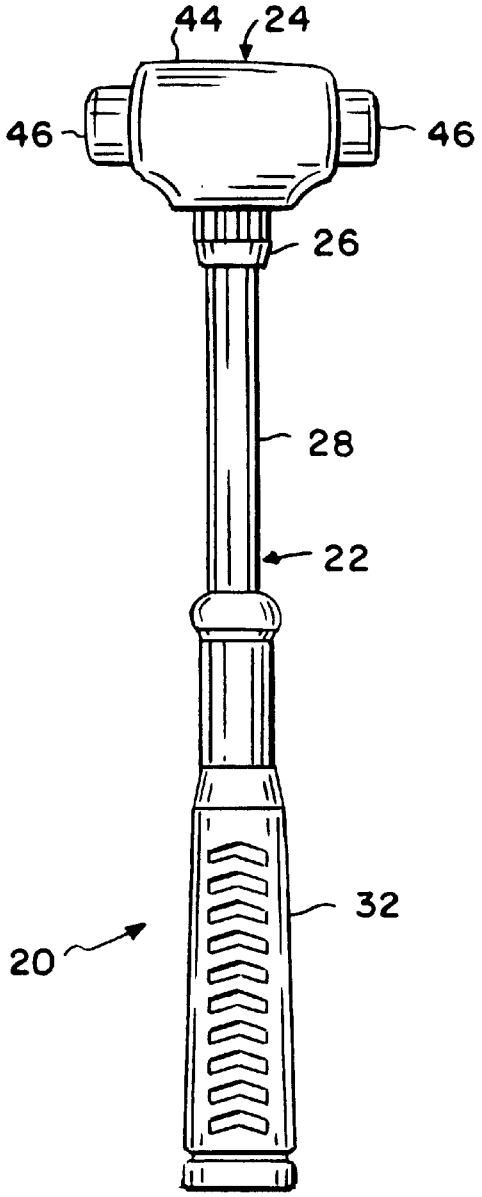
FIG. 2 is a side elevational view of the hand tool of FIG. 1, illustrating assembly of the tool handle to the tool head by inserting the connecting stud into the tool head and turning the handle 90°, and thereafter tightening a nut which is threadable onto a lower end of the connecting stud.
Figure 4:
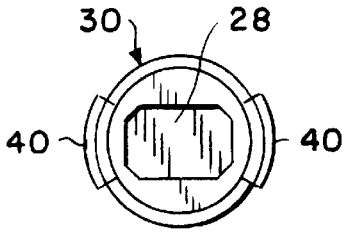
FIG. 4 is a top plan view of the tool handle taken generally along the line 4—4 of FIG. 3.

As shown in the drawings for purposes of illustration, the present invention is concerned with an improved hand tool, generally designated by the reference number 20. The hand tool 20 comprises, generally, a tool handle 22 and a composite tool head 24 that may be releasably attached to the tool handle. A locking nut 26 is provided about a portion of the handle 22 and is threadable thereon so as to engage a lower surface of the tool head 24 when properly positioned on the tool handle to releasably secure the tool head 24 to the tool handle 22.

With reference to FIGS. 1–5, the tool handle 22 comprises a high strength, load-bearing rod 28 which has a connecting stud 30 attached at one end thereof and a grip 32 attached over an end of the rod 28 opposite the connecting stud 30. The grip 32 may be of any desired design, and is typically stylized to provide a soft gripping surface for the hand tool 20. The connecting stud 30, on the other hand, is typically a glass-filled nylon component molded directly onto the end of the rod 28.

The connecting stud 32 includes a lower threaded portion 34, an intermediate cylindrical body portion 36 which defines a shoulder 38, and a pair of oppositely disposed flanges 40 which extend generally perpendicularly outwardly from the remainder of the connecting stud 30. The lower surface 42 of each flange 40 is contoured as shown, for purposes to be discussed in greater detail below.

Figure 7:
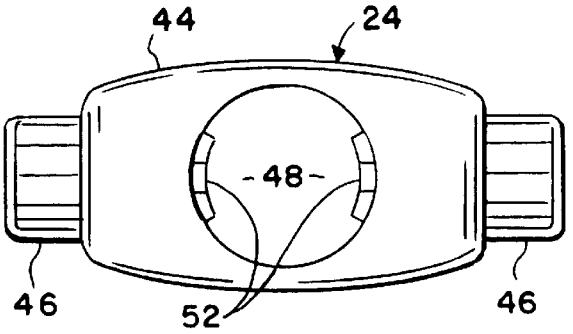
FIG. 7 is a top plan view of the tool head taken generally along the line 7—7 of FIG. 6.
Figure 3:
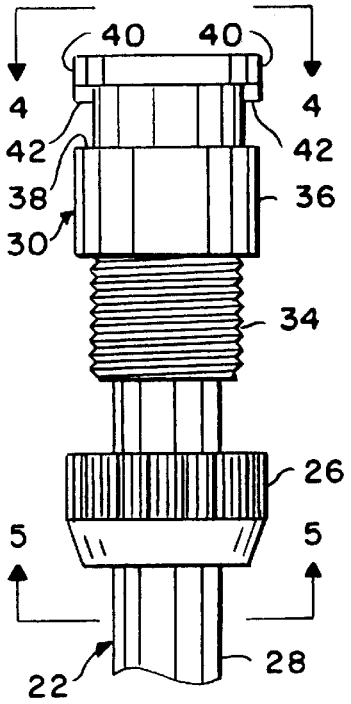
FIG. 3 is an enlarged fragmented elevational view taken generally of the area of the tool handle indicated by the number 3 in FIG. 1.
Figure 6:
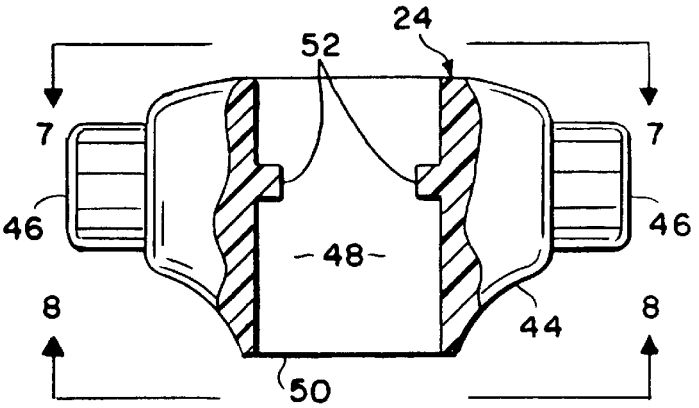
FIG. 6 is an elevational and partially sectional view of an exemplary tool head constructed in accordance with the principles of the present invention.
Figure 8:
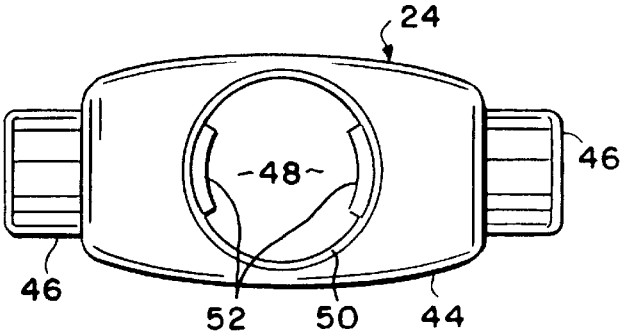
FIG. 8 is a bottom plan view of the tool head taken generally along the line 8—8 of FIG. 6.
Figure 5:
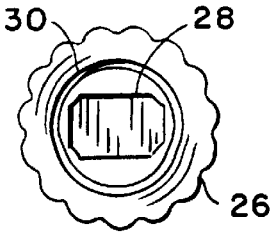
FIG. 5 is a sectional view taken generally along the line 5—5 of FIG. 3.
Figure 9:
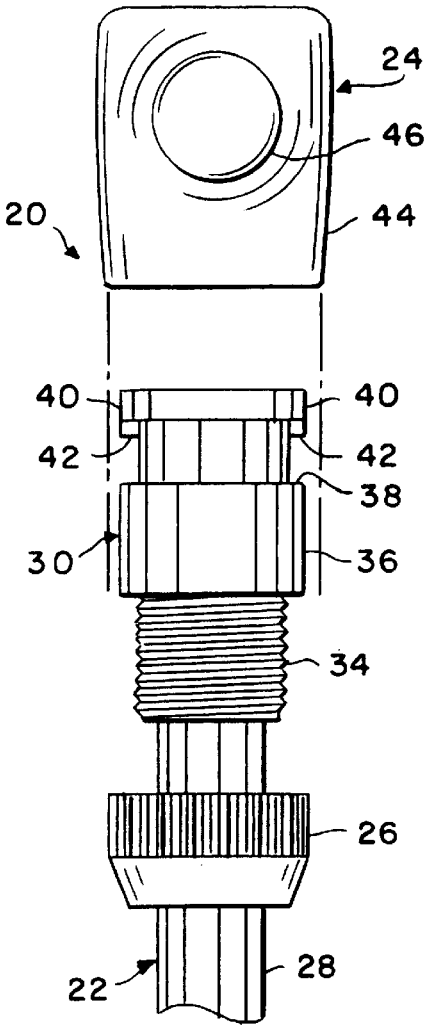
FIG. 9 is an enlarged elevational assembly view of the tool head and an end of the tool handle taken generally along the line 9—9 of FIG. 1.
Figure 12:
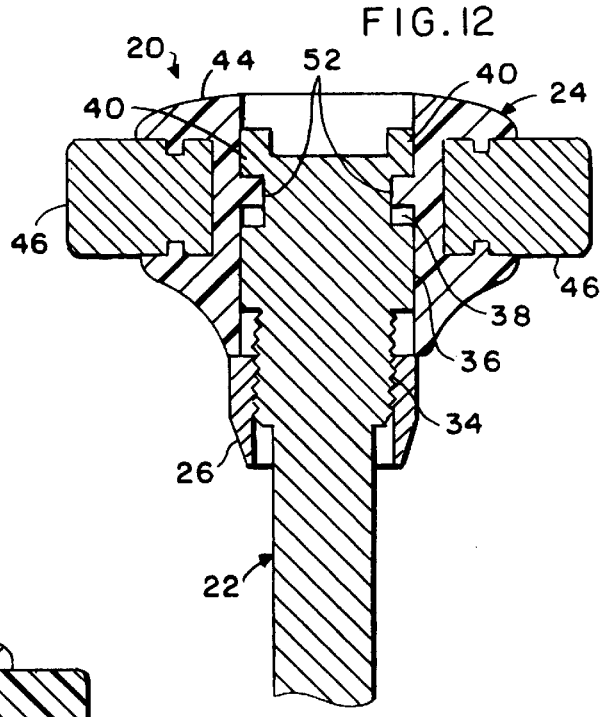
FIG. 12 is a sectional view taken generally along the line 12—12 of FIG. 11.
Figure 13:
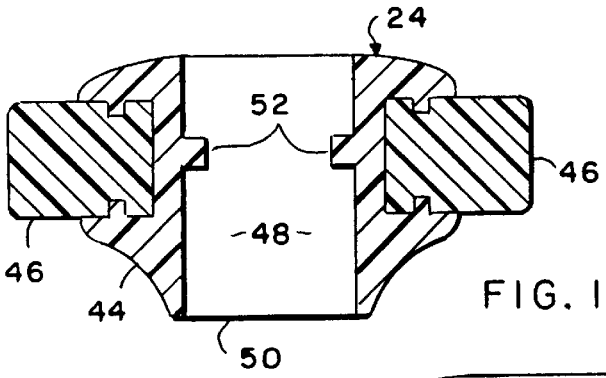
FIG. 13 is a sectional view of an alternative tool head similar to that illustrated in FIG. 6, illustrating different types of materials that may be utilized for the striking tips.
Figure 14:
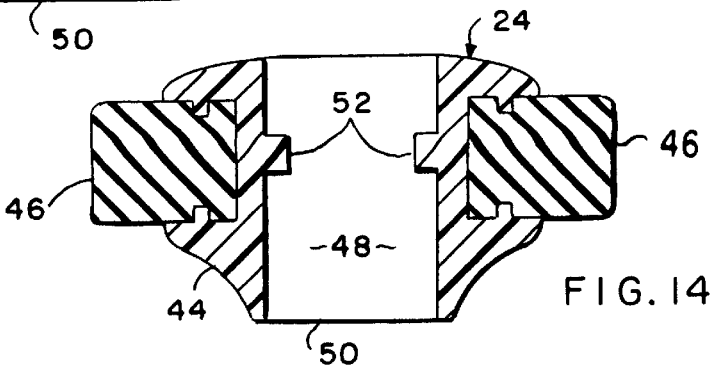
FIG. 14 is another elevational sectional view of a tool head similar to FIGS. 6 and 13, illustrating yet another type of material that can be utilized in the striking tips of a standardized tool head design.

As shown in FIGS. 6–8, the tool head 24 is a composite structure comprising a tool head body 44 and a pair of striking tips 46 about which the tool head body 44 is molded and which striking tips 46 extend outwardly therefrom. The striking tips 46 may be manufactured separately from the tool head body 44 and may be utilized as a molded insert about which the tool head body 44 is molded to secure the tips 46 to the tool head body 44. Further, as illustrated in FIGS. 12–14, the striking tips 46 may be of various different types of materials, including metal (FIG. 12), plastic (FIG. 13) and rubber (FIG. 14).

The tool head body 44 has a central cavity 48 into which the connecting stud 30 is inserted through a tool head aperture 50. The tool head body 44 further includes a pair of lands 52 which extend into the central cavity 48 and are capable of selectively engaging the connecting stud flanges 40 to prevent withdrawal of the connecting stud 30 from the tool head 24. The lands 52 have a surface contour which matches the contour of the lower surface 42 of the flanges 40. The complementary surface contours of the connecting stud flanges 40 and the tool head lands 52 prevent rotation of the handle 22 relative to the tool head 24 when the connecting stud flanges are seated on the corresponding tool head lands and the locking nut 26 engages the tool head 24.

With reference now to FIGS. 1, 2 and 9–12, the process for releasably attaching the tool handle 22 to the tool head 24 will be described. The first step is to orient the tool handle 22 so that it is rotated approximately 90° about its longitudinal axis from the desired orientation of the tool handle 22 relative to the tool head 24 when in use. Such initial orientation of the tool handle 22 (FIGS. 1 and 9) disposes the connecting stud flanges 40 so they will not engage the tool head lands 52 as the connecting stud 30 is inserted into the central cavity 48 of the tool head 24, but rather pass by the lands without engaging them. With the tool handle 22 so oriented, the connecting stud 30 is then inserted into the central cavity 48 fully so that the shoulder 38 of the cylindrical body portion 36 of the connecting stud engages a lower surface of the lands 52. As such, the lands serve to effectively limit the length of handle insertion into the tool head. With the connecting stud 30 so positioned within the tool head 24, the tool handle 22 is turned relative to the tool head 24 in either direction through an arc of less than 360°, and in the illustrated embodiment through an arc of approximately 90° (FIGS. 2 and 10) so that the flanges 40 of the connecting stud 30 engage and are positioned over the respective lands 52 of the tool head 24. The handle 22 is then generally oriented properly for use with the completed hand tool 20.

Figure 10:
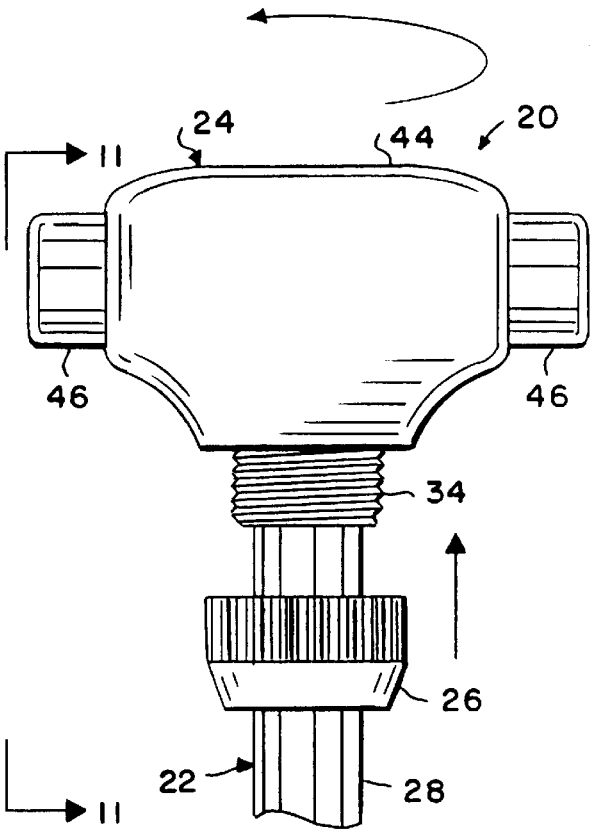
FIG. 10 is a fragmented elevational view similar to FIG. 9, illustrating insertion of the connecting stud of the tool handle into the tool head, and the step of turning the tool handle relative to the tool head.
Figure 11:
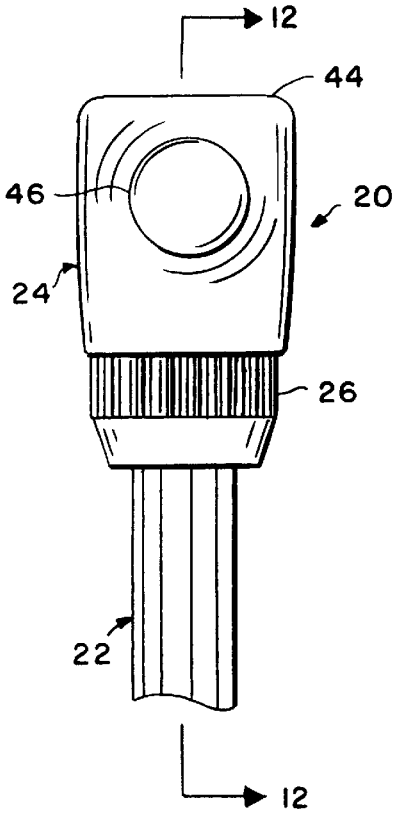
FIG. 11 is a fragmented elevational view of the assembled tool handle and tool head taken generally along the line 11—11 of FIG. 10, wherein a locking nut has been threaded onto a lower end of the connecting stud so as engage a lower surface of the tool head.

With the connecting stud flanges 40 disposed over the lands 52 within the tool head central cavity 48, the tool head 24 is held securely and the handle 22 is pulled away from the head in order to seat the flanges 40 onto the lands 52. The complementary surface contours of the lower surface 42 of the flanges 40 and the upper surface of the lands 52 will effectively prevent rotation of the handle 22 relative to the tool head 24 provided contact is maintained between the complementary and facing surfaces of the flanges 40 and the lands 52. This is accomplished by threading the locking nut 26 onto the lower threaded portion 34 of the connecting stud 30 (FIGS. 10–12). Preferably, the locking nut 26 is secured against the bottom of the tool head 24 finger tight only so as to permit removal and replacement of the tool head 24 without the use of additional tools, as desired.

In order to remove the tool head 24 from the tool handle 22, the above-noted steps are simply reversed. More specifically, the locking nut 26 is unthreaded from the connecting stud threaded portion 34 to enable the tool handle 22 to be pushed upwardly within the tool head 24 to disengage the flanges 40 from the lands 52. The handle 22 may then be turned through a 90° arc to disengage the flanges 40 from the lands 52, after which the handle, and specifically the connecting stud 30, may be removed from the central cavity 48 of the tool head body 44.

Such a procedure may be desirable when it is deemed necessary to provide a tool head 24 having a striking tips 46 of a different composition than those provided by the tool head 24 then in place on the handle 22. The tool head 24 may be removed and replaced as needed, without damaging either the tool head 24 or the tool handle 22.

From the foregoing it will be appreciated that the present invention provides a novel hand tool and a process for releasably attaching a tool handle 22 to a tool head 24 in a quick, efficient and reliable manner. A number of different types of tool heads having different striking tips 46 or other characteristics may be provided with a single handle 22 in kit form. Moreover, the various components of the present invention may be manufactured utilizing standard manufacturing techniques in an efficient manner allowing for economic production of hand tools 20 embodying the present invention.

Although a particular embodiment of the invention has been described in detail for purposes of illustration, various modifications may be made without departing from the spirit and scope of the invention. Accordingly, the invention is not to be limited, except as by the appended claims.

I claim:

1. A hand tool, comprising:

a handle including a connecting stud at one end thereof;

a tool head having an aperture through which the connecting stud may be inserted, the tool head including a land capable of selectively engaging a portion of the connecting stud to prevent withdrawal of the connecting stud from the tool head; and a nut threadable onto the handle and having a face for engaging a portion of the tool head adjacent to the aperture to prevent movement of the connecting stud relative to the tool head and thereby releasably secure the tool head to the handle.

2. The hand tool of claim 1, wherein the connecting stud includes a flange which engages the tool head land to prevent withdrawal of the connecting stud from the tool head.

3. The hand tool of claim 2, wherein the connecting stud flange and the tool head land have complementary surface contours which prevent rotation of the handle relative to the tool head when the connecting stud flange is seated on the tool head land and the nut engages the tool head.

4. The hand tool of claim 2, wherein the connecting stud includes a shoulder spaced from the flange that engages the land when the connecting stud is inserted into the tool head, to limit the length of handle insertion into the tool head.

5. The hand tool of claim 1, wherein the connecting stud includes a cylindrical body portion insertable through the tool head aperture and positioned within a cylindrical cavity of the tool head having substantially the same diameter as the connecting stud.

6. The hand tool of claim 1, wherein the handle comprises a high strength, load-bearing rod to which the connecting stud is attached.

7. The hand tool of claim 6, wherein the nut is threadable onto the connecting stud.

8. The hand tool of claim 6, wherein the handle includes a grip attached over an end of the rod opposite the connecting stud.

9. The hand tool of claim 1, wherein the tool head comprises a tool head body into which the connecting stud is inserted, and at least one striking tip affixed to and extending from the tool head body.

10. The hand tool of claim 9, wherein the striking tip is of a different material than the tool head body.

11. A hand tool, comprising:

a handle including a connecting stud at one end thereof, the connecting stud having a pair of oppositely disposed flanges extending generally perpendicularly outwardly therefrom;

a tool head having a central cavity into which the connecting stud is inserted through a tool head aperture, the tool head including a pair of lands which extend into the central cavity and are capable of selectively engaging the connecting stud flanges to prevent withdrawal of the connecting stud from the tool head; and a nut threadable onto the connecting stud and having a face for engaging a portion of the tool head adjacent to the aperture to prevent movement of the connecting stud relative to the tool head and thereby releasably secure the tool head to the handle.

12. The hand tool of claim 11, wherein the connecting stud flanges and the tool head lands have complementary surface contours which prevent rotation of the handle relative to the tool head when the connecting stud flanges are seated on the corresponding tool head lands and the nut engages the tool head.

13. The hand tool of claim 12, wherein the connecting stud includes a shoulder spaced from the flanges that engages the lands when the connecting stud is inserted into the tool head, to limit the length of handle insertion into the tool head.

14. The hand tool of claim 13, wherein the connecting stud includes a cylindrical body portion which defines the connecting stud shoulder, the cylindrical body portion being insertable through the tool head aperture and positioned within a cylindrical cavity of the tool head having substantially the same diameter as the connecting stud.

15. The hand tool of claim 11, wherein the tool head comprises a tool head body into which the connecting stud is inserted, and at least one striking tip affixed to and extending from the tool head body.

16. The hand tool of claim 15, wherein the striking tip is of a different material than the tool head body.

17. The hand tool of claim 15, wherein the handle comprises a high strength, load-bearing rod to which the connecting stud is attached, and a grip attached over an end of the rod opposite the connecting stud.

* * * * *